US005454653A

United States Patent [19]

Miwa

[11] Patent Number: 5,454,653

[45] Date of Patent: Oct. 3, 1995

[54] PRINTING DEVICE HAVING RECORD MEDIUM FEED MEANS

[75] Inventor: Takahiro Miwa, Kounan, Japan

[73] Assignee: Brother Kogyo Kabushiki Kaisha, Aichi, Japan

[21] Appl. No.: 152,299

[22] Filed: Nov. 15, 1993

[30] Foreign Application Priority Data

Nov. 16, 1992 [JP] Japan ..... 4-305657

[51] Int. Cl.[6] ..... B41J 11/42

[52] U.S. Cl. ..... 400/582; 400/583; 400/615.2

[58] Field of Search ..... 400/582, 583, 400/586, 590, 593, 615.2; 388/800, 825

[56] References Cited

U.S. PATENT DOCUMENTS

| | | | |
|---|---|---|---|
| 3,656,041 | 4/1972 | Bonzano | 400/583.2 |
| 4,004,672 | 1/1977 | Hirano et al. . | |
| 4,062,436 | 12/1977 | Kondur, Jr. et al. | 400/221 |
| 4,192,618 | 3/1980 | Kondur, Jr. et al. . | |
| 4,833,375 | 5/1989 | Del Signore, II | 318/269 |
| 5,200,761 | 4/1993 | Kawakita et al. | 400/120 |
| 5,230,572 | 7/1993 | Hirond et al. | 400/615.2 |
| 5,295,783 | 3/1994 | Godo et al. | 400/615.2 |

FOREIGN PATENT DOCUMENTS

| | | | |
|---|---|---|---|
| 0451830 | 10/1991 | European Pat. Off. . | |
| 0497352 | 8/1992 | European Pat. Off. . | |
| 0512168 | 11/1992 | European Pat. Off. . | |
| 4022654 | 1/1992 | Japan | 400/615.2 |

*Primary Examiner*—Edgar S. Burr
*Assistant Examiner*—John S. Hilten
*Attorney, Agent, or Firm*—Kane, Dalsimer, Sullivan, Kurucz, Levy, Eisele and Richard

[57] ABSTRACT

A printing device which comprises a thermal head for printing a dot pattern image, a driving mechanism for moving a tape which serves as a recording medium, and a DC motor, is disclosed. Printing by the thermal head is inhibited while the DC motor is accelerating. Printing is then executed when the DC motor rotates at a constant speed. The dot pattern image data is printed utilizing a printing frequency having a constant value and which is obtained by dividing a CPU clock. The rotation speed of the DC motor is preset by elements incorporated in the control circuit of the DC motor.

14 Claims, 5 Drawing Sheets

PRINTING DEVICE HAVING RECORD MEDIUM FEED MEANS

FIELD OF THE INVENTION

The present invention relates to a printing device, and more particularly to a tape printing device.

BACKGROUND OF THE INVENTION

Conventionally, one type of printing device is provided with a thermal head on which a plurality of heat generating elements are arranged vertically in a line. The thermal head is moved in a direction orthogonal to the aligned direction of the heat generating elements, by means of a pulse motor, with respect to a sheet on which printing is to be applied. While the thermal head is being moved with respect to the sheet, a selected number (or-all) of the heat generating elements are applied with a pulse-like voltage that energizes them. Thus, dot pattern images can be printed on a heat sensitive sheet, or by transferring ink from a thermal ink ribbon to a sheet. Pulse motors are generally employed as the driving means for driving the head since the driving amount can be controlled accurately. Intervals (spaces) between the printed dots in the horizontal direction are determined by the driving amount. The pulse motor is usually driven in an open loop circuit, and therefore, even in normal conditions, it generates torque to satisfy a maximum load condition. Therefore more energy than necessary is always required, and thus the pulse motor greatly increases the power consumption of the device. This is an important consideration especially in a battery powered printer.

However, in a tape printing device, the printing head remains stationary and the recording medium or tape is fed, by a driving mechanism which also employs a pulse motor. As a result the same power consumption problems as mentioned above will occur.

Recently, to rectify the power consumption problem mentioned above, a DC servo motor provided with an optical encoder or the like for detecting the rotation angle of the motor has been employed. However, the DC servo motor utilizes a feedback control system which thus increases the cost and complexity of the printing device.

SUMMARY OF THE INVENTION

It is therefore an object of the present invention to provide a printing device which can print a non-distorted image employing an inexpensive DC motor, and that does not utilize a complex control system or an encoder.

According to one aspect of the invention there is provided a printing device for printing an image onto a recording medium in accordance with image data, said printing device comprising:

printing means for executing a printing operation;

driving means for feeding said recording medium relative to said printing means, said printing means and said driving means being enabled independently of each other; and controlling means for controlling said printing means to execute printing a during a first predetermined interval while said driving means feeds said recording medium relative to said printing means.

According to another aspect of the invention there is provided a printing device for printing an image onto a recording medium in accordance with image data, said printing device comprising:

printing means for executing a printing operation;

driving means for feeding said recording medium relative to said printing means, said printing means and said driving means being enabled independently of each other; and controlling means for controlling said printing means to execute printing during a first predetermined interval, wherein a feeding speed of said recording medium relative to said printing means remains undetected.

According to a further aspect of the present invention, there is provided a printing device used to print an image onto a recording medium in accordance with image data, said printing device comprising:

printing means for executing a printing operation;

feeding means, comprising a motor, for feeding said recording medium past said printing means, such that said printing means can print said image on said recording medium; and control means to enable said printing means to print said image on said recording medium only when said motor rotates at a constant speed.

DESCRIPTION OF THE ACCOMPANYING DRAWINGS

DESCRIPTION OF THE EMBODIMENTS

In a tape printing device, according to the present invention, the control means controls a driving mechanism to feed the recording tape. A certain period of time is necessary for a DC motor of the driving mechanism to reach a state where it rotates at a constant speed. During this period, printing is inhibited. After this period has elapsed, the rotation speed becomes a constant value, and the driving mechanism can work in a stable state. Then, the control means applies a signal having a constant frequency to the printing head and starts printing.

An electronic tape printing device having a thermal printer, to which the present invention is applied will be described below with reference to the drawings.

Figure 1:
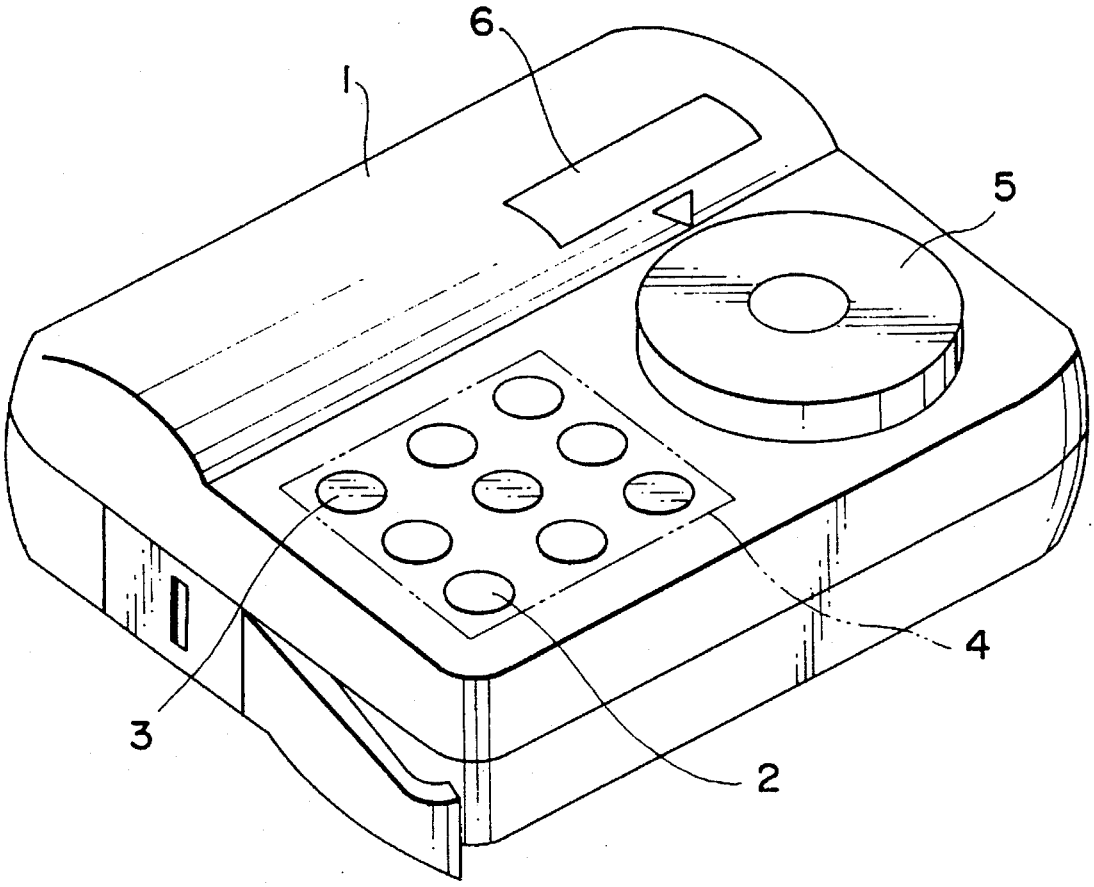
FIG. 1 is a perspective view of a tape printing device embodying the present invention.

As shown in FIG. 1, a keyboard 3 is provided on the upper surface of the body 1 of a tape printing device. The keyboard 3 includes a power switch 2, a print button 3 and other keys. A dial 5 for inputting characters and signs is provided on the righthand side of the keyboard 3. The upper portion of the upper surface of the body 1, above the dial 5, has a liquid crystal display (LCD) 6 for displaying the inputted characters and signs. The character string inputted by the dial 5 is printed, by means of the thermal head, on a tape which serves as a recording medium with use of a thermal transfer ribbon installed in the tape writer.

Figure 2:
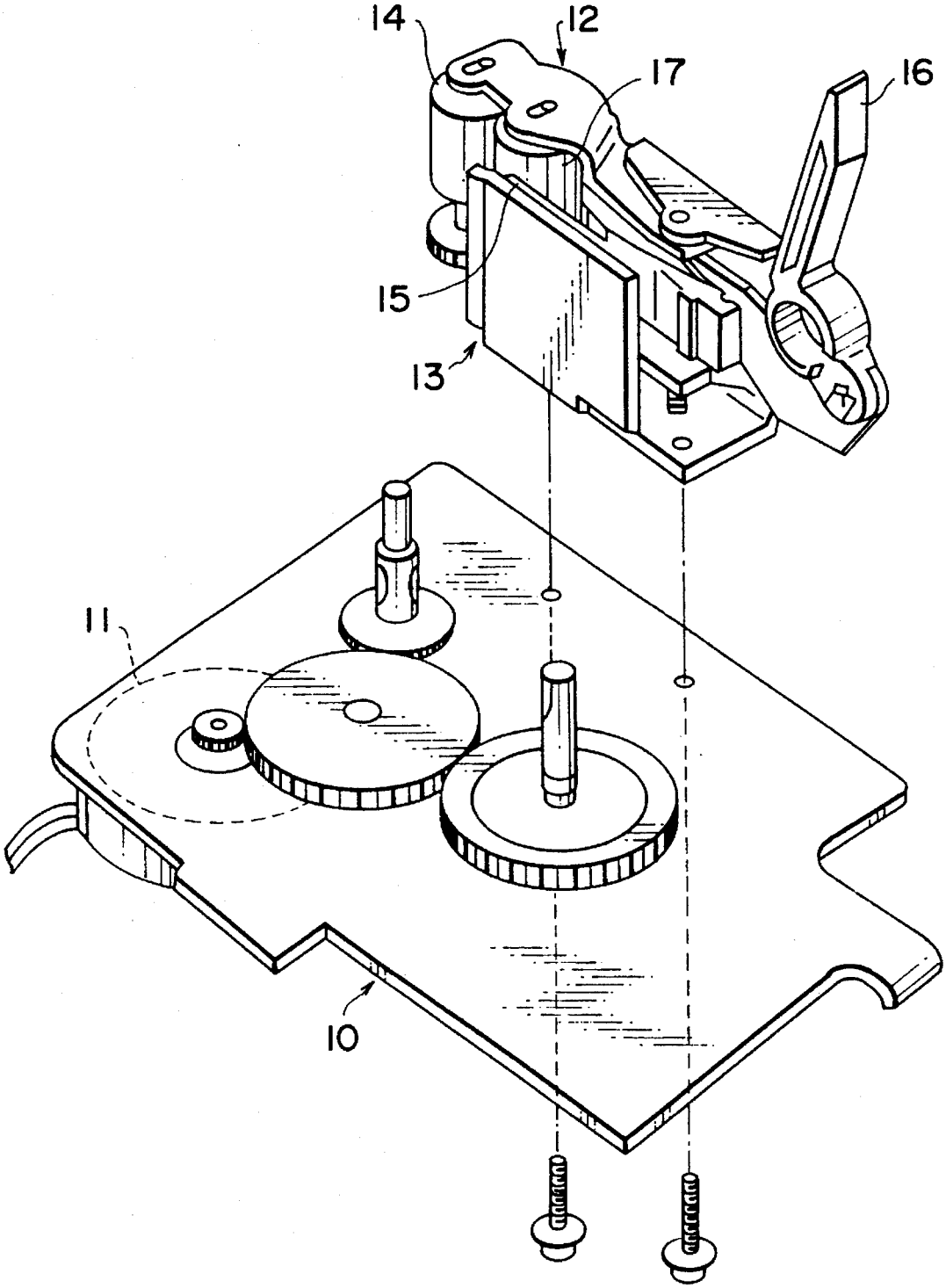
FIG. 2 is an exploded perspective view of the driving unit of the tape printing device.

FIG. 2 shows a perspective view of a driving mechanism of the tape printing device.

On a motor holder 10, a DC motor 11 having two terminals (+) and (–), a roller holder 12, and a head unit 13 are mounted. The driving force of the motor 11 is transmitted to a tape feeding roller 14 through a gear, to move a tape (not shown) and the thermal transfer ribbon (not shown), with respect to a thermal head 15. A roller release lever 16 can be operated so that it is one of two positions. In one position a platen roller 17 and the thermal head 15 nip the tape and the thermal transfer ribbon (not shown). In the other position, tape and thermal transfer ribbon are released.

Figure 3:
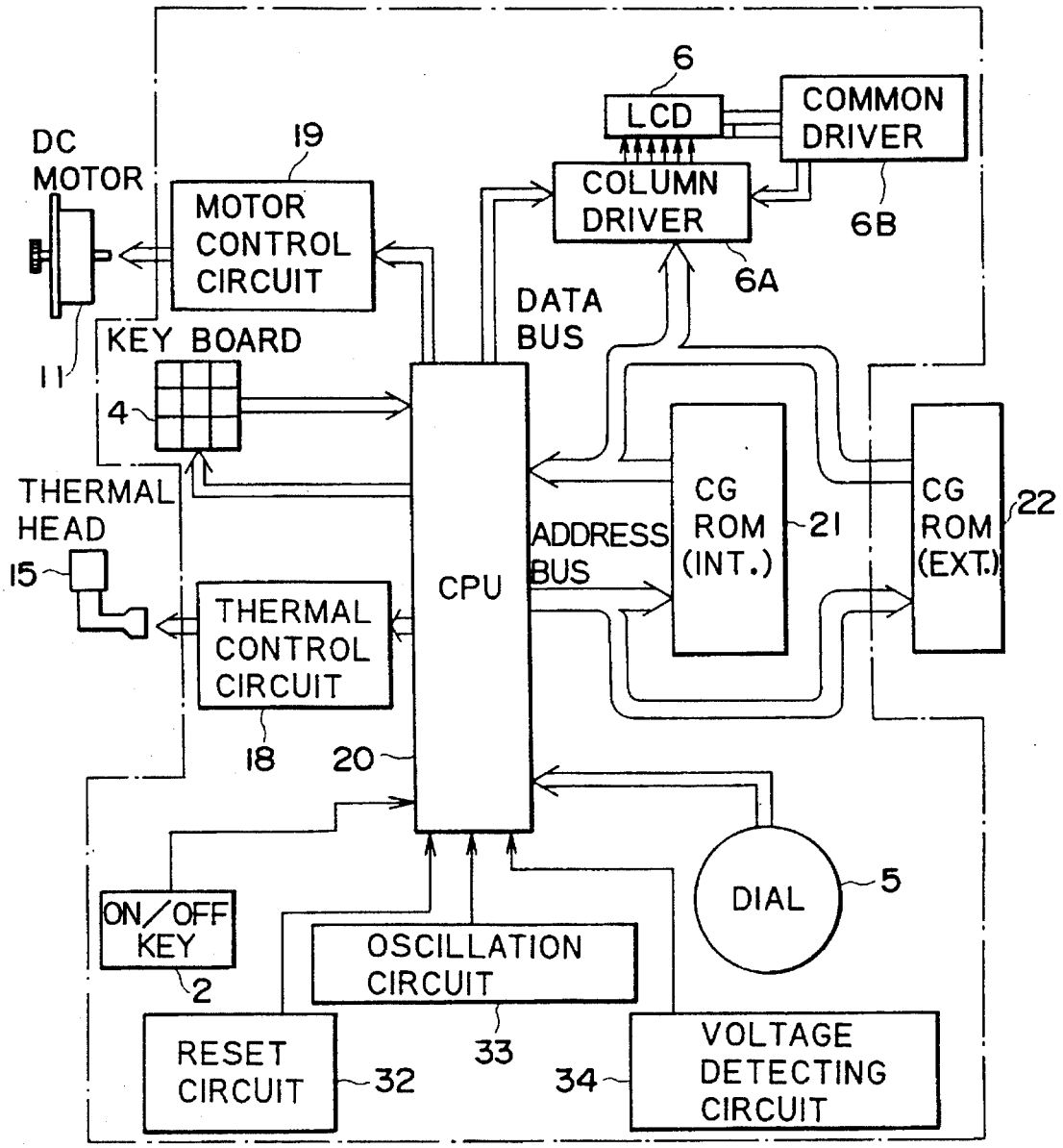
FIG. 3 is a block diagram illustrating the electronic construction of the tape printing device.

FIG. 3 is a block diagram illustrating the control of the tape printing device.

Based on data inputted through keyboard 4 and/or dial 5, a CPU 20 which serves as a controller retrieves a dot pattern from either an internal character generator (CGROM) 21 or an external character generator 22. The CPU 20 then outputs the dot pattern data to the liquid crystal display (LCD) 6 and thermal control circuit 18. The CPU 20 also outputs a drive signal (ON/OFF signal) to a motor control circuit 19 in accordance with the operation of the print button 3. When the print button 3 is operated, the CPU sends an ON signal to the motor control circuit 19. This controls the DC motor 11 to rotate at a constant speed. Thus, the DC motor 11 is driven to feed the tape and the ribbon pass the thermal head 15. At the same time, the CPU 20 outputs data to the thermal control circuit 18 to indicate which recording elements (heat generating elements) are to be heated. The recording elements were heated in order to print the characters, inputted from the dial 5, and generated by the character generator 21, are printed on the tape.

Figure 5:
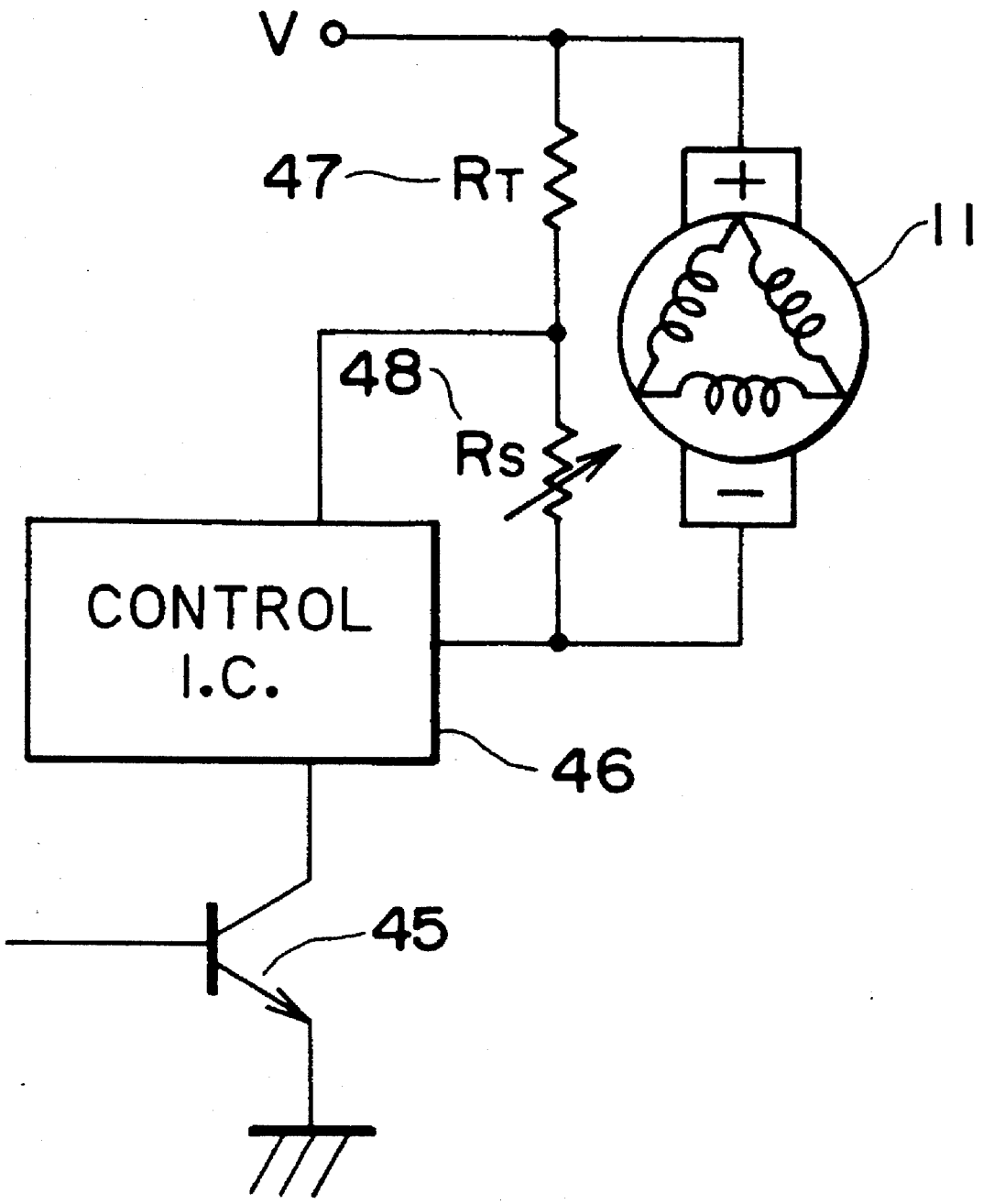
FIG. 5 is a motor controlling circuit.

FIG. 5 shows an example of the motor controlling circuit 19. A switching transistor 45 turns ON or OFF the motor controlling circuit 19 in accordance with the ON/OFF signal from the CPU. A controlling IC 46, for example TDA1151 (manufactured by SGS-ATES), together with resistor RT47 and another resistor RS48, controls the DC motor to rotate at the constant speed. The speed of rotation is determined by the controlling IC 46 and the resistor RS48. With the above construction, an ON/OFF signal applied to the motor controlling circuit 19 will drive the DC motor 11 to rotate at a constant speed. Therefore there is no need to detect the speed of the motor by using a pulse encoder or a feedback circuit.

The power switch (ON/OFF key) 2, a reset circuit 32 for initializing the CPU 20 when the power switch 2 is ON, an oscillation circuit 33 for generating a reference clock frequency, and a voltage detecting circuit 34 for detecting the voltage of the incorporated battery are connected to the CPU 20. Further, a column driver 6A and a common driver 6B for actuating the liquid crystal display 6 are also connected to the CPU 20.

In the electronic tape printing device constructed as above, the CPU 20 inhibits printing immediately after the DC motor 11 starts rotating and is accelerating. After the rotation speed of the DC motor 11 becomes constant, the CPU 20 controls the recording elements (heat generating elements) to generate heat, and execute printing. The frequency of the driving signal that the CPU 20 transmits to the thermal controlling circuit 18 remains constant.

Figure 4:
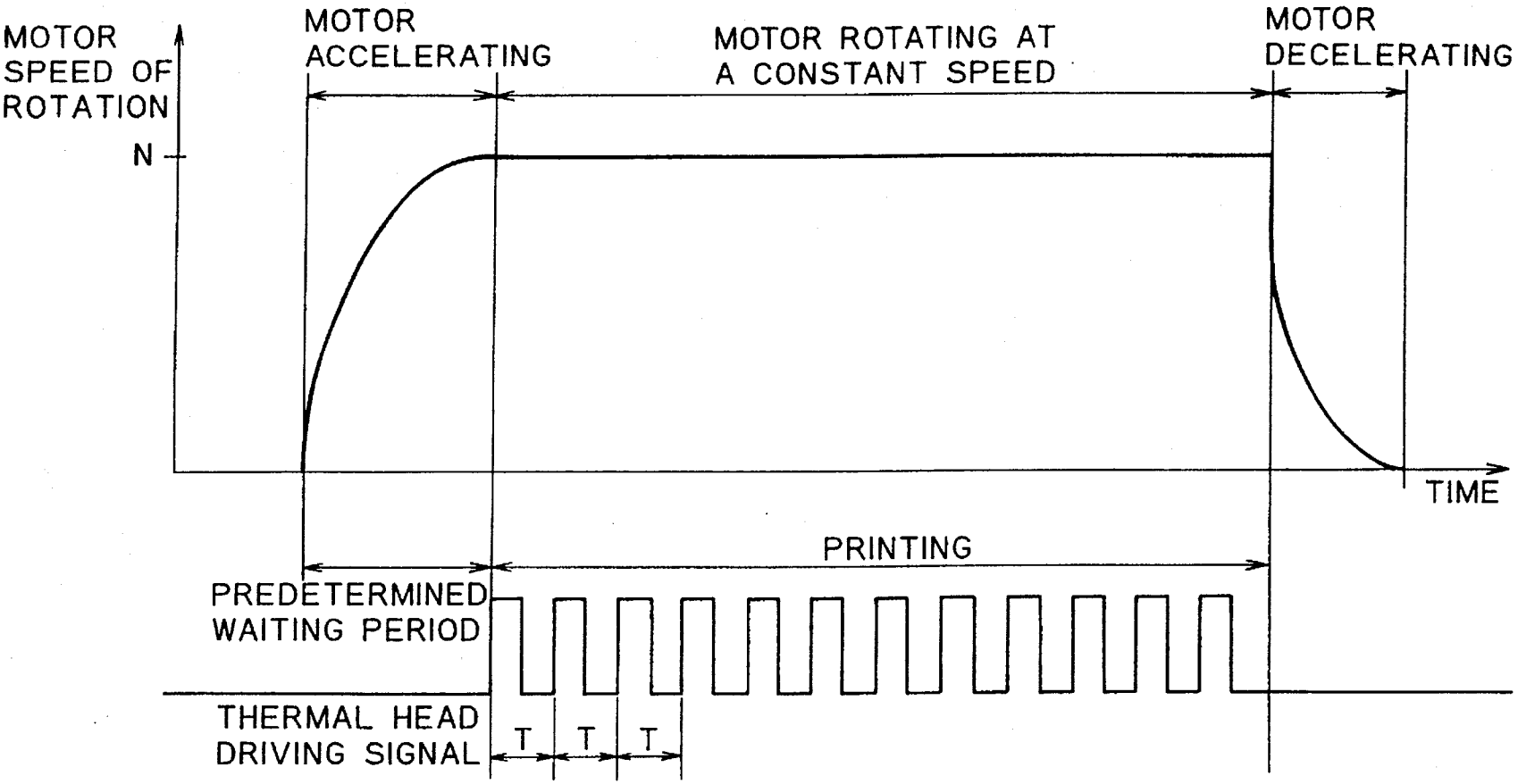
FIG. 4 is a timing chart showing the starting and stopping characteristics of a DC motor.

FIG. 4 is a timing chart showing the relationship between the accelerating-decelerating characteristic of the DC motor 11 and the driving signal applied to the thermal head 15. A character string inputted through dial 5 is converted by the CPU 20, based on a dot pattern of the character generator 21 or 22, into one-line data corresponding to the line of the recording elements of the thermal head 15. The thermal head driving signal shown in FIG. 4 is a signal indicating the period where the voltage can be applied to the thermal head. The thermal controlling circuit 18 controls the necessary recording elements based on the driving signal and the one-line data, and executes printing. The driving signal is a constant frequency signal which is generated by the CPU 20 by counting the clock signal generated by the oscillating circuit 33.

As shown in FIG. 4, since printing is executed within a zone where the moving speed of the tape is constant, and since the thermal head 15 is driven by the signal having a constant frequency, characters can be printed without distortion. In a period in which the motor is accelerating, the tape is slightly fed and printing is inhibited. Printing is started a predetermined period after the start of the rotation of the motor. Thus printing will occur only after the motor has achieved a constant speed of rotation.

As described above, even with a mechanism which is inexpensive but cannot accurately control the driving amount of the tape on a dot basis, printing can be executed without distortion. Further, because the DC motor has a good energy efficiency characteristic, power consumption is considerably lower than the case where the pulse motor is employed.

As described above, according to the present invention, as a motor for driving a recording medium, a DC motor which is inexpensive and has a good energy efficiency characteristic can be employed, thus the power consumption is considerably lower than the case where the pulse motor is employed.

What is claimed is:

1. A printing device for printing an image onto a recording medium in accordance with image data, said printing device comprising:

printing means for executing a printing operation;

a DC motor driven to rotate at a constant speed for feeding said recording medium relative to said printing means, said printing means and said DC motor being enabled independently of each other; and means to allow said motor to accelerate to a constant speed before the start of printing, said means to allow including open loop controlling means for inhibiting printing for a first predetermined period after said DC motor starts rotating, said DC motor rotating at said constant speed after said first predetermined period has passed and for controlling said printing means to execute printing during a second predetermined interval while said DC motor feeds said recording medium relative to said printing means.

2. The printing device according to claim 1, wherein said printing means comprises a plurality of printing elements arranged in a line.

3. The printing device according to claim 2, wherein said controlling means drives said plurality of printing elements by applying a driving signal having a predetermined frequency.

4. The printing device according to claim 2, wherein said DC motor feeds said recording medium substantially orthogonal to the line of said plurality of printing elements.

5. The printing device according to claim 1, wherein said recording medium comprises a tape.

6. A printing device for printing an image onto a recording medium in accordance with image data, said printing device comprising:

printing means for executing a printing operation;

DC motor driving means for feeding said recording medium relative to said printing means, said printing means and said driving means being enabled independently of each other; and means to allow said motor to accelerate to a constant speed before the start of printing, said means to allow including an open loop controlling means for controlling said printing means without a feedback system and for inhibiting printing for a first predetermined interval after said driving means starts feeding said recording medium relative to said printing means and before said DC motor has reached a constant speed and to execute printing during a first predetermined interval when said DC motor has reached a constant speed.

7. The printing device according to claim 6, wherein said driving means comprises a DC motor that is driven to rotate at a constant speed.

8. The printing device according to claim 7, wherein said controlling means inhibits printing for a second predetermined period after said motor started rotating, said motor being deemed to rotate at said constant speed after said predetermined period has passed.

9. The printing device according to claim 6, wherein said printing means comprises a plurality of printing elements arranged in a line.

10. The printing device according to claim 9, wherein said controlling means drives said plurality of printing elements by applying a driving signal having a predetermined frequency.

11. A printing device used to print an image onto a recording medium in accordance with image data, said printing device comprising:

printing means for executing a printing operation;

DC motor feeding means, comprising a motor, for feeding said recording medium past said printing means, such that said printing means can print said image on said recording medium; and means to allow said motor to accelerate to a constant speed before the start of printing, said means to allow including open loop control means to enable said printing means to print said image on said recording medium only when said motor rotates at a constant speed, wherein the printing means is enabled regardless of the amount of recording medium fed by said feeding means, said control means inhibiting said printing means from printing said image on said recording medium during a predetermined interval after said motor has started to rotate and before said DC motor has reached a constant speed.

12. The printing device according to claim 11 wherein said recording medium is a tape.

13. The printing device according to claim 11 wherein said printing means comprises a thermal head having a plurality of printing elements arranged in a line.

14. The printing device according to claim 13 wherein said control means drives said plurality of printing elements by applying a driving signal having a predetermined frequency.

* * * * *